US010859357B2

(12) United States Patent
Kezerian

(10) Patent No.: US 10,859,357 B2
(45) Date of Patent: Dec. 8, 2020

(54) SABOT, BORE RIDER, AND METHODS OF MAKING AND USING SAME

(71) Applicant: Simulations, LLC, East Granby, CT (US)

(72) Inventor: Jeffrey M Kezerian, East Granby, CT (US)

(73) Assignee: Simulations, LLC, East Granby, CT (US)

( * ) Notice: Subject to any disclaimer, the term of this patent is extended or adjusted under 35 U.S.C. 154(b) by 69 days.

(21) Appl. No.: 16/004,076

(22) Filed: Jun. 8, 2018

(65) Prior Publication Data

US 2018/0356194 A1 Dec. 13, 2018

Related U.S. Application Data

(60) Provisional application No. 62/517,291, filed on Jun. 9, 2017.

(51) Int. Cl.
*F42B 14/06* (2006.01)

(52) U.S. Cl.
CPC ..... *F42B 14/062* (2013.01); *F42B 14/067* (2013.01); *F42B 14/068* (2013.01)

(58) Field of Classification Search
CPC ..... F42B 14/068; F42B 14/06; F42B 14/022; F42B 14/067; F42B 14/062
See application file for complete search history.

(56) References Cited

U.S. PATENT DOCUMENTS 3,802,345 A 4/1974 La Costa
4,296,687 A 10/1981 Garrett
4,542,696 A * 9/1985 Bisping ..... F42B 14/061 102/430
4,958,571 A * 9/1990 Puckett ..... F42B 14/061 102/522
5,259,321 A 11/1993 Pahnke
6,829,997 B1 * 12/2004 Hilleman ..... F42B 14/064 102/522
7,594,472 B1 * 9/2009 Parratt ..... F42B 14/061 102/520
7,935,208 B2 5/2011 Park et al.
8,142,586 B2 3/2012 Park et al.
8,561,544 B2 10/2013 Baumann et al.
8,678,042 B2 3/2014 Quigley et al.
8,695,507 B1 4/2014 Musali et al.
9,052,173 B2 6/2015 Minnicino, II
2009/0107355 A1 * 4/2009 Park ..... F42B 14/061 102/521

(Continued)

FOREIGN PATENT DOCUMENTS

WO WO-2008097392 A2 * 8/2008 ..... F42B 14/064

OTHER PUBLICATIONS

John Tsibouklis and Thomas G. Nevell; Ultra-Low Surface Energy Polymers: The Molecular Design Requirements; Advanced Materials; Apr. 17, 2003; 647-650; Wiley, Weinheim.

*Primary Examiner* — Stephen Johnson
(74) *Attorney, Agent, or Firm* — UConn IP Law Clinic; Nestor Rodriguez Smyt; Jesse Mangiardi

(57) ABSTRACT

Sabots and riders are described herein that have high torsional stiffness, providing for utility in high-speed projectiles. The sabots include multiple petals with a closed configuration comprising polymer or metal containing composites. Corresponding systems and methods also are disclosed.

14 Claims, 2 Drawing Sheets

(56) References Cited

U.S. PATENT DOCUMENTS

| | | | |
|---|---|---|---|
| 2010/0276082 | A1 | 11/2010 | Park et al. |
| 2016/0282094 | A1 | 9/2016 | Brown |
| 2017/0146329 | A1 | 5/2017 | Scarr |

* cited by examiner

SABOT, BORE RIDER, AND METHODS OF MAKING AND USING SAME

CROSS-REFERENCE TO RELATED APPLICATIONS

This application claims priority to, and the benefit of, U.S. Provisional Patent Application No. 62/517,291 filed Jun. 9, 2017.

BACKGROUND

Sabots and bore riders are used in gun bores during firing (launching) to 'guide and carry' sub-caliber projectiles, as well as complex integrated launch packages (ILPs), during the entire in-bore launch event. One of the fundamental tasks of the sabot and riders is to keep the projectile centered laterally while in-bore, minimizing lateral movement, deflections and potential stresses. For many ILPs the sabot and riders also act as the axial load path and component that transfers the actual setback loads to the projectile package. Once the ILP exits the gun muzzle the sabot and riders discard themselves essentially from the launch package thus allowing the projectile to travel ballistically in free flight.

The sabot is the device assembled around the outside of the projectile that keeps the projectile centered in the gun bore during launch. Since the sabot is discarded upon muzzle exit, it must be designed so it can separate itself from the projectile. This is commonly done by having the sabot made of at least two sections, named petals. It is common to have two, three or four petals per sabot, yet sabots with more petals have been developed. When all the petals are assembled around the projectile, it is that final petal assembly referred to as the sabot. Upon muzzle exit these petals jettison away from the projectile, initiated by the stagnation pressure in the front of the sabot developed in-bore during launch. There are other methods of using stagnation pressure in the mid-section and/or aft section of the sabot which can also initiate discard. These are commonly referred to as mid and rear discard methods. Additional forces that contribute to discard are due to the air flow surrounding the sabot and petals once the sabot has exited the barrel.

For guns and launch systems where there are no rifling grooves on the bore surface, for example smooth-bore guns, polar-moment-of-inertia (PMOI) and torsional stiffness are not structural properties purposely designed into the sabots and riders. Polar-moment-of-inertial and torsional stiffness are part of the essential structural properties of the sabot for rifled bores due to the rotational and torsional loads. For ILPs launched in smooth-bore guns there are no rotational and torsional loads thus PMOI and torsional stiffness are not key structural concerns. Although the devices and embodiments described herein can be used in these systems, they are not required.

In rifled gun bores, the sabot, riders, projectile and all other components in the ILP undergo torsional stress due to rotation induced by the rifling grooves. It would be useful to develop improved designs of sabots and riders that can withstand high torsional stresses.

SUMMARY

One embodiment disclosed herein is a sabot petal comprising a tube with a closed cross-sectional area. In embodiments, the tube has a wall comprising an outer peripheral wall surface including an interior wall surface section configured to be positioned around a projectile to be launched in a rifled bore gun. The tube contacts an adjacent tube when the tube is positioned around a projectile. In embodiments, the tube is configured to provide a higher polar moment-of-inertia, torsional stiffness, and torsional constant as compared to a sabot petal that does not have a closed cross-sectional area. These advantages are realized due to a closed cross-sectional geometry of the tube perpendicular to its longitudinal axis. Compared to conventional petals that do not have a closed cross-section, the tube therefore can withstand higher stresses, have less angular deflection, and fundamentally provide higher torsional stiffness.

In one embodiment, the first tube has a wall comprises an outer peripheral wall surface having an interior wall surface section configured to surround a projectile, an exterior wall surface section, a first side wall surface section configured to contact an adjacent petal, and a second side wall surface section configured to contact an adjacent petal. In some cases, the wall has a cavity formed therein at the first side wall surface section that is configured to receive an anti-slip pin.

In certain configurations, the tube comprises a fiber reinforced polymer composite (FRPC). In embodiments, the tube comprises a carbon fiber reinforced polymer composite, with the carbon fibers oriented at specific helix angles to react to the torsional stress.

In some cases, the tube comprises braided carbon, glass, aramid, boron, and/or other materials, fabricated by industry known as sleeves. In embodiments, the tube can also comprise single unidirectional ply stacked lamina at predetermined helix angles, with or without additional lamina oriented at other directions, as well as incorporating braid sleeves previously described.

Another embodiment is a method of using the tube in a launch package. A further embodiment is a method of making a petal for a sabot, comprising forming a closed tube around a mandrel using unidirectional fibers arranged at an angle relative to the central longitudinal axis of the sabot.

Yet another embodiment is a system comprising a sabot including at least two sabot petals each having a closed cross-sectional area, the petals surrounding a sub-caliber projectile. In embodiments, the sabot has a wall with a tapered wall thickness. In some cases, the sabot petals have mating concave/convex depressions forming anti-slip surfaces between adjacent rib surfaces.

A further embodiment is a method of making a sabot having a longitudinal axis, the method comprising forming a plurality of petals, each comprising a tubular sleeve containing fibers in a matrix, a plurality of the fibers being orientated at an angle relative to the longitudinal axis of the sabot and positioning the petals around a projectile.

BRIEF DESCRIPTION OF THE DRAWINGS

Some embodiments are illustrated as an example and are not limited by the figures of the accompanying drawings, in which like references may indicate similar elements and in which.

DETAILED DESCRIPTION

Figure 1:
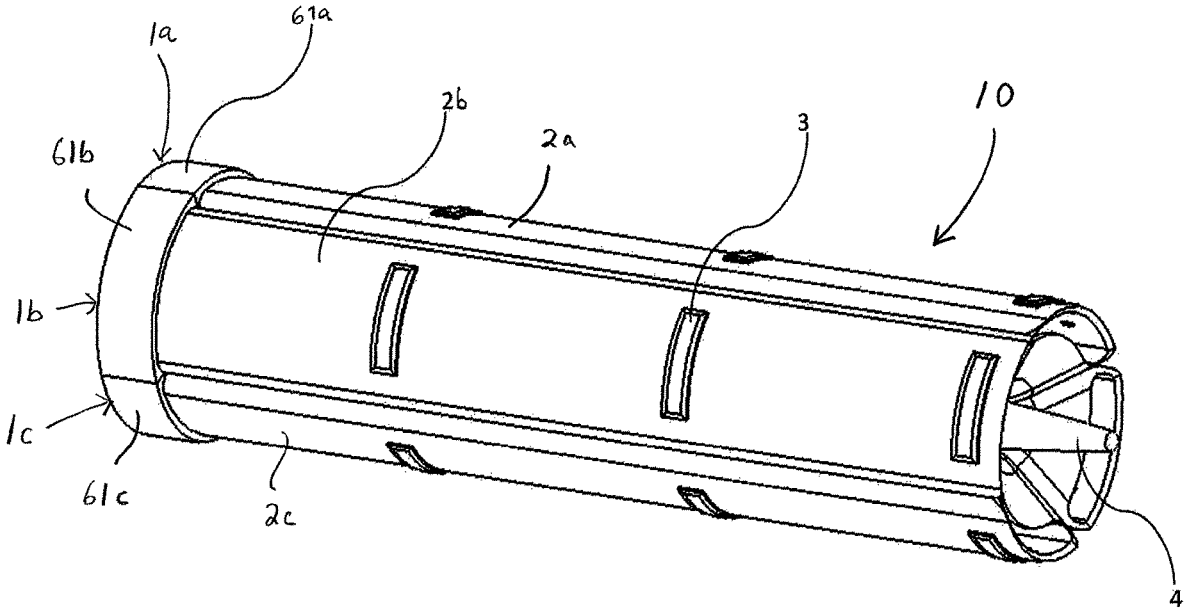
FIG. 1 is a front isometric view of an embodiment of an integrated launch package (ILP) with a projectile, a pusher plate subassembly, riders, and the common features of a sabot made up of tubular petals with a closed cross-sectional shape.

The embodiments described herein relate to the novel use of a tubular cross-section, closed-body-of-revolution device that can be used as a sabot petal or bore rider itself that requires elevated polar moment-of-inertia and torsional stiffness when launched in high velocity rifled guns. More specifically, with the industry's ongoing requirement to decrease excess mass (parasitic mass) in launch packages, lightweight materials such as composites are used for the sabots and it is with these types of materials the disclosed embodiments will notably aid in increasing the torsional stiffness to withstand the elevated torsional stresses induced by rifling loads.

The terminology used herein is for the purpose of describing particular embodiments only and is not intended to be limiting. As used herein, the term "and/or" includes any and all combinations of one or more of the associated listed items. As used herein, the singular forms "a", "an", and "the", are intended to include the plural forms as well at the singular forms, unless the context clearly indicates otherwise. It will be further understood that the terms "comprises" and/or "comprising", when used in this specification, specify the presence of stated features, various types of closed cross-sectional areas, quantity of petals, varying cross-sections, various fiber architectures, supporting hardware such as riders, pusher plates, and/or groups thereof.

Unless otherwise defined, all terms (including technical and scientific terms) used herein have the same meaning as commonly understood by one having ordinary skill in the art to which this disclosure belongs. It will be further understood that the terms, such as those defined in commonly used dictionaries, should be interpreted as having a meaning that is consistent with their meaning in the relevant and the present disclosure and will not be interpreted in an idealized or overly formal sense unless expressly so defined herein.

Definitions: As used herein, the term "composite" means a material made from two or more constituent materials with significantly different physical or chemical properties that, when combined, produce a material with characteristics different from the individual components. The individual components remain separate and distinct within the finished structure, differentiating composites from mixtures and solid solutions. The new material may be preferred for many reasons: common examples include materials which are stronger, lighter, or less expensive when compared to traditional materials.

As used herein, the term "polymer composite" refers to a thermoplastic or thermoset set matrix, such as a resin, epoxy, or plastic matrix that is filled with carbon, glass, boron, and/or other constituents. In some cases, the filler is a reinforcing material. In some cases, the filler is fibrous, forming a fiber-reinforced polymer (FRP). In some cases, the filler is used to adjust the weight of the component.

A "metal matrix composite" (MMC) as used herein refers to a metal matrix material, such as aluminum, titanium, magnesium, cobalt, or another metal, which is then filled with a different non-metallic or metallic material such as an organic compound, such as carbon, a glass, or a ceramic. In some cases, the filler is a reinforcing filler. In some cases, the filler is used to adjust the weight of the component.

Decreasing the mass of sabots and riders is desirable. Composites can be made that have a lower mass than conventional materials such as aluminum and steel. However, in composite sabot systems, the torsional stresses induced due to rotation push the strength limitations of conventional composite material; thus composites have not yet been routinely exploited in rifled guns. Therefore, the industry continues to use aluminum alloy materials as the chosen material for sabots in medium and large caliber rifled bore guns.

In general, the density of aluminum alloys is about twice the density of carbon fiber reinforced polymer (CFRP) composites. Therefore, using composites in place of aluminum for a typical sabot reduces the sabot mass by about fifty (50) percent. Moreover, since the strength and stiffness of composites can be customized, a more efficient and optimized sabot geometry can be engineered with composites and the mass savings can be greater than fifty percent. However, this novel tube approach originally developed with composites is applicable in aluminum or any homogeneous material as well. The choice of material, mass savings, and methods to approach the sabot design is a function of the typical ballistic complex variables such as projectile geometry, axial load path requirements, loader and handling requirements, bore size, costs, impact on target, etc. The embodiments described herein offer solutions to address the industry's current inability to use composites in rifled bores.

A drawback of conventional aluminum sabots for launch packages in rifled bore guns is their mass, as discussed above. As technology moves forward, requiring higher velocities, increased accelerations, and the need for customized strengths and material properties in sabots, aluminum density and homogenous material properties become its limiting factor. High velocities are required more and more due to the logistics of military defense. It is useful to replace aluminum with a lightweight material so the next generation of hypervelocity projectiles is realized.

Another drawback to using aluminum sabots is that its material strength and stiffness are isotropic (i.e. the same in all directions). Since there is rarely the case where the strength and stiffness properties are required to be the same in all directions of a sabot, there is, therefore, no driving requirement to use isotropic material as the sabot material, thus aluminum material is by default 'over-designed' for the sabot. In embodiments, the composite material is engineered and fabricated to have the exact strength, stiffness, and material properties as required in each direction as needed, and is thusly specifically fabricated per each sabot application, allowing for optimized thickness in those various directions, thus minimizing mass. The disclosed embodiments allow for composites to be exploited and used in rifled guns.

One embodiment comprises a novel sabot geometry and novel use of composites that individually, and in combination with one-another, increase the polar moment-of-inertia and torsional stiffness of each sabot petal such that they can withstand the elevated stresses induced by rifling. Embodiments disclosed herein allow for each petal to have a tubular closed cross-section area, rather than a conventional open cross-section area. By having a tubular (closed) cross-section area for the petal, the petal will twist less when subjected to a given torque. By definition polar-moment-of-inertia mathematically represents objects with a constant circular cross-section, which is the fundamental mathematical basis of the disclosed embodiments. However, since the majority of the actual ILP cross-sectional area perpendicular to the axis-of-travel is not constant and varies, its closed-form solution is therefore a complicated mathematical expression which is needed to calculate the actual torsional stiffness. This torsional stiffness can be calculated using various advanced mathematical techniques, 3D elastic theory, and finite element methods. The disclosed embodiments show that using a closed crossed-section area for the petals significantly increases the torsional stiffness, e.g. the overall torsional constant of the sabot increases. The torsional constant is the relationship between the torque applied to the object (petal) and the resulting angle of twist the object (petal) undergoes; the lower the angle for a given torque the higher its torsion constant. The fundamental formulation is $\theta=TL/JG$, where $\theta$ is the angle of twist, T is the applied Torque, L is the length of the object (petal), J is the torsional constant, and G is the modulus of rigidity (shear modulus) of the material. Using a closed cross-section area for each petal (rather than an open cross-section area) increases the torsional constant J in the above equation, which therefore decreases the petal's angle of twist $\theta$. It is critical to note that $\theta$ in this relationship is the angle of deformation for each petal as it is strained, and not the angle of rotation the ILP from rifling. The angle $\theta$ represents the resulting deformation and angular strain of its own body due to its own elastic properties.

The embodiments described herein propose the use of a closed cross-sectional area for a petal to replace an open cross-sectional region. The use of, for example, fiber reinforced polymer composites (FRPC) in this arrangement allows for the implementation of off-axis fibers within the fiber architecture to further increase the petal's shear strength and Modulus of Rigidity G. Composites that have off-axis fibers, e.g. braided sleeves, provide fibers oriented at a customized and at a specific helix angle to resist the helical torsional stresses. It is these off-axis fibers that increase the material's Modulus of Rigidity G resulting a desirous lower angle of twist $\theta$. Other manufacturing methods to provide these off-axis helix fibers can be used, including but not limited to, unidirectional lamina oriented at predetermined transverse angles, weaved preforms oriented at predetermined angles, as well as a hybrid single filament winding. Depending on the torque in which the petal and sabot is subjected, along with the required torsion constant, geometry, fiber type and density, and so on, the helix angle (e.g. off-axis angle) is custom engineered and chosen. With these off-axis fibers and/or braided sleeves with fibers oriented at predetermined helix angles in combination with the closed cross-sectional area of the petal tube geometry provide the increased strength and stiffness composite sabots need in rifled gun bores. The various composite architectures of fiber, lamina, weaves, and braids are essentially endless, and depend on the torsional stiffness and stress requirements of each ILP and gun system platform. To further reduce stresses, a method can be employed to decrease the angle of twist by mechanically locking the petals together during firing while still allowing them to separate at muzzle exit. Devices that can be used to accomplish this result are interlocking pins (anti-slip pins) multifaceted locking plates, as well as convex/concave surfaces in mating side walls that also constrain slip between mating petals. The interlocking pins, multifaceted locking plates, or mating convex/concave depressions would be positioned between two mating petals such that they prevent relative motion between the adjacent surfaces of the two petals. As will be discussed below, this feature is illustrated using pins (which are shown for simplicity). The pins prevent relative motion between the petal surfaces yet do not impede the petals from separating and discarding during muzzle exit.

In describing the disclosed embodiments, it will be understood that several techniques are disclosed. Each of these has individual benefits and each can be used in conjunction with one or more, or in some cases all, of the other disclosed techniques. Accordingly, for the sake of clarity, this description will refrain from repeating every possible combination of the various petal concepts. Nevertheless, the specification and claims should be read with the understanding that such combinations are entirely within the scope of the claims. Advanced methods to increase the torsional stiffness, minimize twist, and increase Modulus or Rigidity of sabot petals are discussed herein. In the following description, for purposes of explanation, numerous specific details are set forth in order to provide a thorough understanding of the disclosed embodiments.

Figure 2:
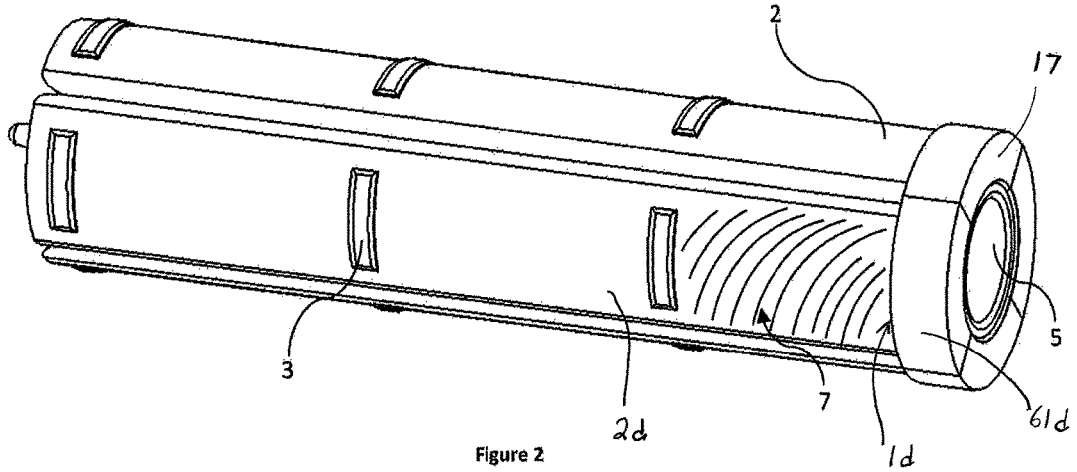
FIG. 2 is a rear isometric view of an assembly of the launch package depicted in FIG. 1.
Figure 3:
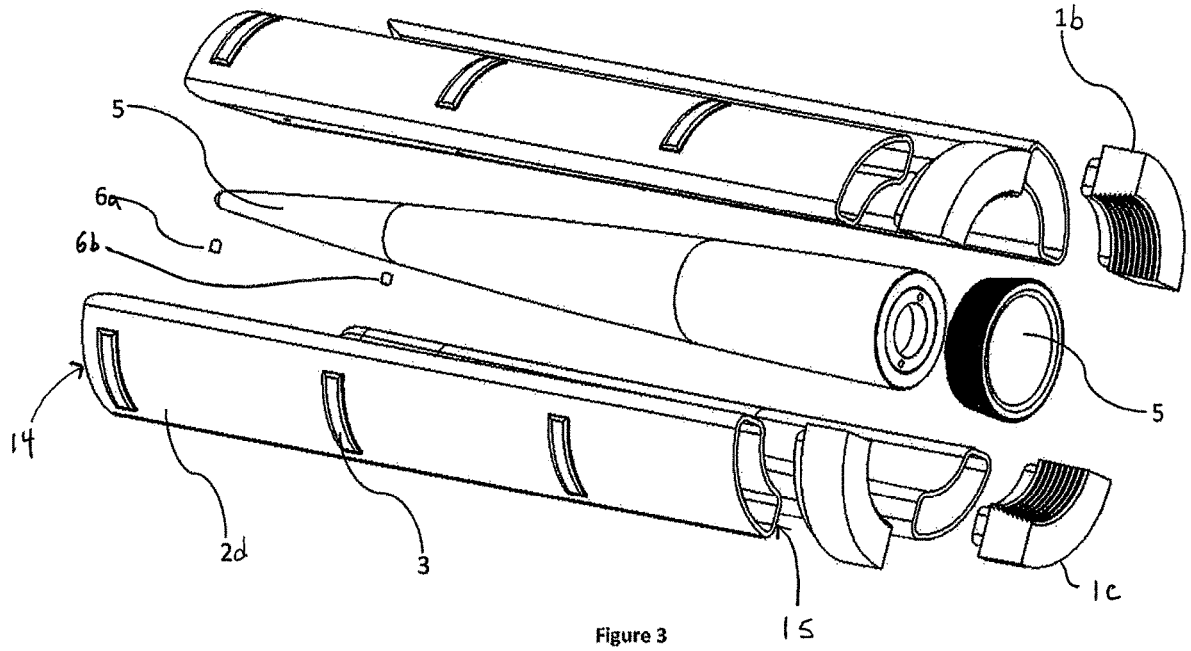
FIG. 3 is an exploded view of the launch package shown in FIG. 2.

Referring to the drawings, FIGS. 1-2 illustrate a first embodiment of an integrated launch package 10 for a rifled-bore gun. The disclosed embodiments also can be used in smooth-bore guns, e.g. to assist in handling and for loading systems. The Insert Pushers 1, Sabot Petals 2, Riders 3, and Projectile 4 are shown. In this example, there are four insert pushers 1*a*, 1*b*, 1*c* and 1*d*, four sabot petals 2*a*, 2*b*, 2*c* and 2*d*, twelve riders 3, and one projectile 4. The view in FIG. 2 shows the Pusher Plate 5 and, in one section, shows the detail of the helix angle fibers 7 in the body of the petal. The petals comprise a composite material. FIG. 3 also shows the optional Anti-Slip Pins 6. Four to eight anti-slip pins typically are used per ILP, or four multifaceted locking plates. For the assembly shown in FIGS. 1-3, there are eight anti-slip pins total, two of which are shown as 6*a* and 6*b*.

Figure 4:
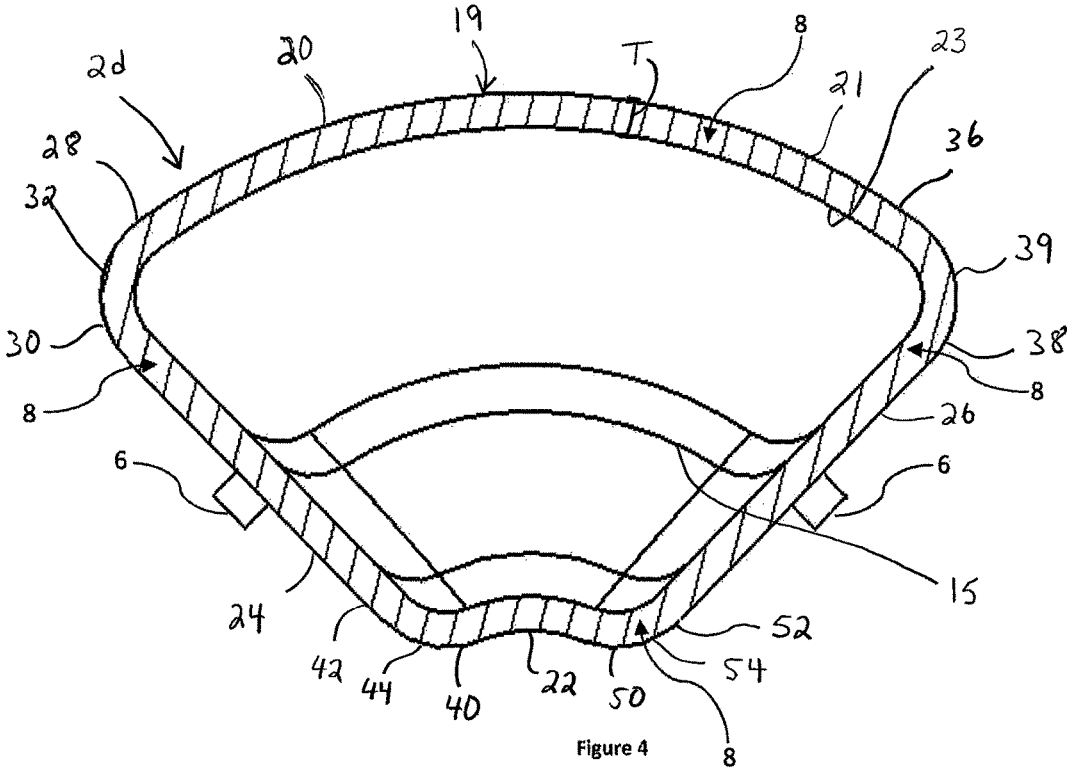
FIG. 4 illustrates the cross-sectional view of a sabot petal highlighting that the petal itself is a continuous structure with a closed-body-of-revolution cross-section.

FIG. 4 shows the closed cross-sectional area 8 of a petal 2*d*. The petal 2*d* comprises a tapered tube with a closed cross-sectional area. The cross-sectional area is generally shaped as a slice of pie with the tip removed. The illustrated embodiment has four petals and therefore the cross section of each petal is shaped as one quarter of a whole pie with the tip removed. As is shown in FIGS. 3-4, the front end 14 of the petal 2*d* has a larger cross-section than the rear end 15. The petal 2*d* includes an elongated annular wall 19 having a thickness T. While the embodiment shown in the figures has a uniform wall thickness, the wall 19 alternatively can have a non-uniform wall thickness. This non-uniform wall thickness is considered a tapered wall with the aft end 15 being thicker than the forward end 14. This tapered wall thickness is a benefit to decreased mass due to the inherent torsional stiffness of this invention. The wall 19 has an outer peripheral wall surface 21 and an inner peripheral wall surface 23. The outer peripheral wall surface 21 includes an outwardly curved exterior wall surface section 20, a concave interior wall surface section 22, a first side wall surface section 24 and a second side wall surface section 26. Both petal wall surface sections 24 and 26 are shown straight (flat) herein yet are also designed with mating convex/concave depressions in area 8 and wall thickness 9 such that their mating surfaces of nearby petals interlock during assembly. A first side 28 of the outer wall surface section 20 is connected to an outer side 30 of the first side wall surface section 24 by a generally outwardly curved first outer connecting wall surface section 32 (commonly referred to as a fillet). A second side 36 of the exterior wall surface section 20 is connected to an outer end 38 of the second side wall surface section 26 by a generally outwardly curved second outer connecting wall surface section 39 (e.g. fillet). A first side 40 of the inner wall surface section 22 is connected to an inner end 42 of the first side wall surface section 24 by a generally outwardly curved first inner connecting wall surface section 44. A second side 50 of the interior wall surface section 22 is connected to an inner end 52 of the second side wall surface section 26 by a generally outwardly curved first inner connecting wall surface section 54. The advantage of the curved corners is that they aid minimizing and transferring stresses in the petal material as compared to a configuration in which sharp corners are used. The interior wall surface section 22 is a custom shape (e.g. tapered, conical, ogive, or straight for the trivial case) which conform to the shape of the projectile, shown in FIG. 4.

The petals are configured with the intent to be torsion and compression resistant geometry. This configuration enables use of lightweight materials while at the same time enabling hypervelocity launches. When the projectile is fully inserted into the gun, the propellant cartridge is placed in the gun and seated against the aft surface of the insert pusher 1 and pusher plate 5. When the cartridge is installed, the breech of the gun is closed and the system is ready for firing. Upon firing, the propellant ignites and becomes a high temperature gas that thermally expands applying pressure on the insert pusher 1 and pusher plate 5 thus accelerating the launch package 10. As the propellant continues expanding and applying pressure onto the launch package aft faces 17 (see FIG. 2), the projectile launch package velocity keeps increasing. Upon muzzle exit the launch package 10 has reached its maximum velocity and heads down range to the target. While in-bore, the outer surfaces 61*a*, 61*b*, 61*c* and 61*d* of the insert pushers 1*a*, 1*b*, 1*c* and 1*d*, have an obturator seal (typically a polymer) that becomes interlocked into the gun rifling grooves. Thus, with the insert pushers 1*a*, 1*b*, 1*c* and 1*d* interlocked with the obturator seal, and the obturator interlocked with the gun bore rifling grooves on the inner diameter of the barrel, the insert pushers 1*a*, 1*b*, 1*c* and 1*d* therefore rotate with the same angular frequency as the rifling grooves. Since all the components are mechanically interlocked with each other, the entire launch package in-phase with insert pushers 1*a*, 1*b*, 1*c* and 1*d*. Since all these components rotate torsional stresses are induced into each component. These torsional stresses are where the disclosed configuration is applied. The torsional stresses are withstood by the disclosed embodiments. In smoothbore guns, the significant stresses are compressive (depending on the design of the launch package). When projectiles are launched in rifled-bore guns, high compressive stresses also exist however, yet significant torsional stresses are also induced. For this example, the sabot petals 2*a*, 2*b*, 2*c* and 2*d* have the tubular closed cross-section that allows for the geometry to significantly resist and withstand the torsional stresses and angular deformation. Having this closed cross-sectional area 8 increases the torsional stiffness of the sabot petal which is part of the embodiments disclosed herein. Based on the size, weight and intended velocity of a projectile, the cross-sectional area and geometry is engineered accordingly to provide the torsional stiffness needed. The intent of these approaches is to further increase torsional stiffness by placing off-axis helix angle fibers 7 into the body of the petal material, for example when using composite materials. When using a combination of helix angled fibers 7 and a configuration that employs a closed cross-sectional area 8, sabot petal torsional stiffness can be designed with composite materials to withstand torsional stresses of current rifled gun bores.

The optional incorporation of anti-slip pins 6 shown in FIG. 3 (or multifaceted interlocking plates, or mating convex/concave depressions, of wall section 24 in FIG. 4), prevents relative sliding between mating petals. As the launch package rotates down the bore of the gun, the entire package twists relative to itself. As the twisting is induced, each petal will attempt to slide along the surfaces of its mating petal. If there is sufficient twist to the entire petal set, then the amount of sliding will be sufficient. As a result, this will increase the already occurring compressive and tensile stresses in the petal body. The anti-slip pins 6 interlock each petal to each other assisting in minimizing the slip (relative motion) between petals. By preventing relative motion (slip) between petals, stresses can be significantly decreased. The anti-slip pins 6 are designed such that they mechanically lock the petals together during launch while in bore to prevent relative slip between petals, yet freely allow the petals to separate and discard upon muzzle exit. Without the anti-slip pins 6, in some embodiments, slipping between petals can induced large compressive and tensile stresses. Using the anti-slip pins 6 addresses these stresses and mitigates them appreciably such that compressive and tensile stresses can be well below the petal material strength limit.

The selection of an appropriate fiber angle will depend upon, for example, the materials used to make the petals, the petal wall thicknesses, and the size and velocity of the projectile. In embodiments, the helix fiber angles are in the range of about 20 to about 80 degrees relative to the central axis the of the launch package. In some cases, a braided material is used. In embodiments, the off-axis angle of a braided sleeve can be in the range of 20 to 80 degrees.

Non-limiting methods of making the petals include forming sleeves and/or woven preforms, and/or unidirectional laminate. Unidirectional laminate can be applied about mandrel at a chosen helix angle followed by additional unidirectional laminate parallel to the bore centerline, or as needed. Additional unidirectional laminate can be applied oriented at a predetermined angle, and then wrapped in a braided sleeve.

In embodiments, the petals have a multilayer construction. One non-limiting technique to manufacture multilayer petals is by weaving, braiding, conventional 2D layup, or a hybrid of two or all these methods. In some multilayer embodiments, Z fibers (out-of-plane fibers) are incorporated by use of textiling, weaving and/or stitching, and extend radially from one layer to an adjacent layer, or extend through multiple layers. In embodiments, a multi-layer petal will typically have 5 to 7 layers, yet a small caliber sabot petal may have 2-4 layers, while a large caliber sabot petal may have 25-40 layers or more. The advantage of incorporating Z fibers is that the Z fibers help to prevent delamination and peeling.

Non-limiting examples of launch package dimensions are as follows: the launch package typically has a diameter in the range of about 0.8 to 12 inches. The petals typically have a wall thickness in the range of about 0.040 inches to about 0.5 inches.

In embodiments, the tube has an increased Modulus of Rigidity G as compared to conventional products. In embodiments, the fiber reinforced polymer composite provides improved conformability and increased Modulus of Rigidity G as compared to conventional products. In embodiments, the tube increases the polar moment-of-inertia, torsional stiffness, and torsional constant of the sabot. The tube reduces the effect of induced torsional stresses on the sabot.

In embodiments, the tube comprises a fiber reinforced polymer composite. In some cases, the fibers are carbon, and the carbon fibers are at a helix angle oriented with the torsional stress. In embodiments, the tube comprises single ply stacked lamina at an appropriate helix angle, with or without additional lamina oriented at other directions As indicated above the tube may further comprise at least one of anti-slip pins and mechanically interlocking features at petal-to-petal mating rib walls. In embodiments, the anti-slip pins or other mechanically interlocking features prevent relative slip during in-bore acceleration yet freely allow the petals to separate and discard during muzzle exit. In embodiments, the anti-slip pins decrease the each petal's strain angle of twist B (deformation).

The number of petals used depends upon projectile range, velocity, direct or indirect fire, target impact requirements, launch package mass, and the actual gun system platform. In embodiments, the launch package consists of two to six petals positioned around a projectile. In embodiments, the petals comprise a thermoplastic, thermoset polymer, or metal matrix composite. The composite often contains a reinforcing fiber. Non-limiting examples of suitable reinforced fiber polymer composites include a polymer such as epoxy, polyester, and/or vinyl ester with fibers of carbon, glass, aramid or basalt.

The present disclosure is to be considered as an exemplification of the invention and is not intended to limit the invention to the specific embodiments illustrated by the figures or description below.

What is claimed is:

1. A sabot petal comprising a first tube with a closed cross-sectional area, wherein the first tube has a wall comprising an outer peripheral wall surface including an interior wall surface section configured to be positioned around a projectile, the first tube comprising fiber, as a lamina, braid, or weave, at a helix angle in the range of 20 to 80 degrees relative to a central axis of the projectile.

2. The sabot petal of claim 1, wherein the first tube contacts an adjacent second tube when the first and second tubes are positioned around the projectile.

3. The sabot petal of claim 1, wherein the first tube further comprises a metal matrix composite.

4. The sabot petal of claim 1, wherein the first tube comprises a carbon fiber reinforced polymer.

5. The sabot petal of claim 1, wherein the first tube comprises a braided carbon, a glass, a boron, or an aramid material.

6. The sabot petal of claim 1, wherein the first tube has an exterior wall surface section, a first side wall surface section configured to contact an adjacent petal, and a second side wall surface section configured to contact an adjacent petal.

7. The sabot petal of claim 6, wherein the wall has a cavity formed therein at the first side wall surface section that is configured to receive an anti-slip pin.

8. The sabot petal of claim 6, wherein the first tube further comprises a metal matrix composite.

9. The sabot petal of claim 6, wherein the first tube comprises a carbon fiber reinforced polymer.

10. The sabot petal of claim 6, wherein the first tube comprises a braided carbon, a glass, a boron, or an aramid material.

11. The sabot petal of claim 1, wherein the wall has a tapered thickness.

12. The sabot petal of claim 11, wherein the first tube further comprises a metal matrix composite.

13. The sabot petal of claim 11, wherein the first tube comprises a carbon fiber reinforced polymer.

14. The sabot petal of claim 11, wherein the first tube comprises a braided carbon, a glass, a boron, or an aramid material.

* * * * *